US006774801B2

(12) United States Patent
Phillips et al.

(10) Patent No.: US 6,774,801 B2
(45) Date of Patent: Aug. 10, 2004

(54) CLOCK AND AMBIENT AIR CONDITION SENSING APPARATUS

(76) Inventors: Terri L. Phillips, 66 Traver Rd., Gansevoort, NY (US) 12831; Blair Sutton, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 10/292,538

(22) Filed: Nov. 12, 2002

(65) Prior Publication Data

US 2004/0090336 A1 May 13, 2004

(51) Int. Cl.[7] ..... G08B 17/10

(52) U.S. Cl. ..... 340/628; 340/629; 340/630; 340/693.5; 340/515; 340/693.1

(58) Field of Search ..... 340/628, 629, 340/630, 632, 636, 693.1, 693.2, 693.5, 515

(56) References Cited

U.S. PATENT DOCUMENTS

| | | | | |
|---|---|---|---|---|
| 4,186,389 A | | 1/1980 | Flittie | |
| 4,321,591 A | | 3/1982 | Vieweg | |
| 4,540,980 A | | 9/1985 | Porco | |
| 4,611,200 A | | 9/1986 | Stilwell | |
| 4,632,177 A | * | 12/1986 | Beckey | 165/239 |
| 4,796,015 A | | 1/1989 | Admire, Jr. | |
| 4,949,077 A | | 8/1990 | Mbuthia | |
| 5,309,145 A | * | 5/1994 | Branch et al. | 340/540 |
| 5,574,436 A | * | 11/1996 | Sisselman et al. | 340/663 |
| 5,786,768 A | | 7/1998 | Chan et al. | |
| 5,936,532 A | | 8/1999 | Peralta | |

* cited by examiner

*Primary Examiner*—Jeffery Hofsass
*Assistant Examiner*—Hung Nguyen
(74) *Attorney, Agent, or Firm*—Dale J. Ream

(57) ABSTRACT

A clock and ambient air condition sensing apparatus includes an alarm and ambient air sensor positioned in a housing and operatively connected to a logic circuit. The logic circuit is capable of evaluating air sensor data and energizing the alarm upon a preselected ambient air condition. A first battery is connected to the circuit for powering the air sensor. The housing includes a front cover pivotally movable between open and closed configurations. A clock is mounted to the front cover for displaying a relative time and is releasably electrically connected to the circuit. A second battery is connected to the circuit for powering the clock. The circuit is capable of evaluating the strength of the first and second batteries and of directing current from the second battery to the air sensor if the first battery is inoperable.

5 Claims, 7 Drawing Sheets

CLOCK AND AMBIENT AIR CONDITION SENSING APPARATUS

BACKGROUND OF THE INVENTION

The present invention relates generally to a combination clock and air sensing apparatus and, more particularly, to a clock and ambient air condition sensing apparatus having dual power sources and which alerts users to an inoperability of a power source by ceasing the clock function while still powering the air condition sensor.

It is widely accepted that having multiple smoke, carbon monoxide, or heat detectors mounted throughout one's residence is a significant safety benefit. However, such ambient air condition detectors often have an unsightly aesthetic appearance. Another problem with air condition detectors is that it is difficult to determine when each detector's battery has become inoperable and needs to be changed.

Various devices have been proposed in the art for housing a smoke or carbon monoxide sensor within a clock unit so as to improve the aesthetic appearance of the device. In addition, it has been proposed that a user will be alerted to an inoperability of the device's battery when the clock ceases to function. Although presumably effective for their intended purposes, the existing devices do not alert users to a failure of the air condition sensor power source by ceasing the clock function while still providing power to the air sensor.

Therefore, it would be desirable to have an apparatus which combines a clock and an ambient air condition sensor within a single, decorative housing. Further, it would be desirable to have a clock and air condition sensing apparatus which includes a dual battery power source. In addition, it would be desirable to have an apparatus which alerts a user to a failure of the air condition sensor battery power source by a cessation of the clock function and which then diverts current from a clock battery source to the air condition sensor to maintain operability thereof.

SUMMARY OF THE INVENTION

A clock and ambient air condition sensing apparatus according to the present invention includes an alarm and an ambient air condition sensor, such as a smoke sensor, positioned within a housing. The apparatus includes a clock mounted to a front cover of the housing. A logic circuit is positioned within the housing and electrically connected to both the air condition sensor and the clock. First and second battery power sources are also positioned within the housing and electrically connected to the circuit. The circuit is capable of directing current from the batteries to the air condition sensor and clock. Under normal operation, current from the first battery is directed by the circuit to the air condition sensor and current from the second battery is directed to the clock. The circuit regularly evaluates the operability of the batteries and, if the first battery is inoperative, the circuit directs current from the second battery to the air condition sensor. Obviously, the clock is no longer energized when current from the second battery is diverted to the air condition sensor. Accordingly, a user is alerted to a battery failure by the cessation of clock function but yet is not left unprotected from sensing dangerous ambient air conditions such as smoke, heat, or carbon monoxide.

Therefore, a general object of this invention is to provide an apparatus which combines a clock and an ambient air condition sensor in a single decorative housing.

Another object of this invention is to provide an apparatus, as aforesaid, having independent battery power sources for energizing the ambient air condition sensor and clock under the control of a logic circuit.

Still another object of this invention is to provide an apparatus, as aforesaid, which monitors the operability of the dual battery power sources.

Yet another object of this invention is to provide an apparatus, as aforesaid, which directs current from the clock battery power source to the air condition sensor when the air condition sensor battery power source is inoperative.

A further object of this invention is to provide an apparatus, as aforesaid, which alerts a user to an inoperability of a battery by ceasing the clock function and other visual means.

A still further object of this invention is to provide an apparatus, as aforesaid, which includes decorative clock face coverings.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A clock and ambient air condition sensing apparatus according to the present invention will now be described in detail with reference to FIGS. 1 through 7B of the accompanying drawings.

Figure 1:
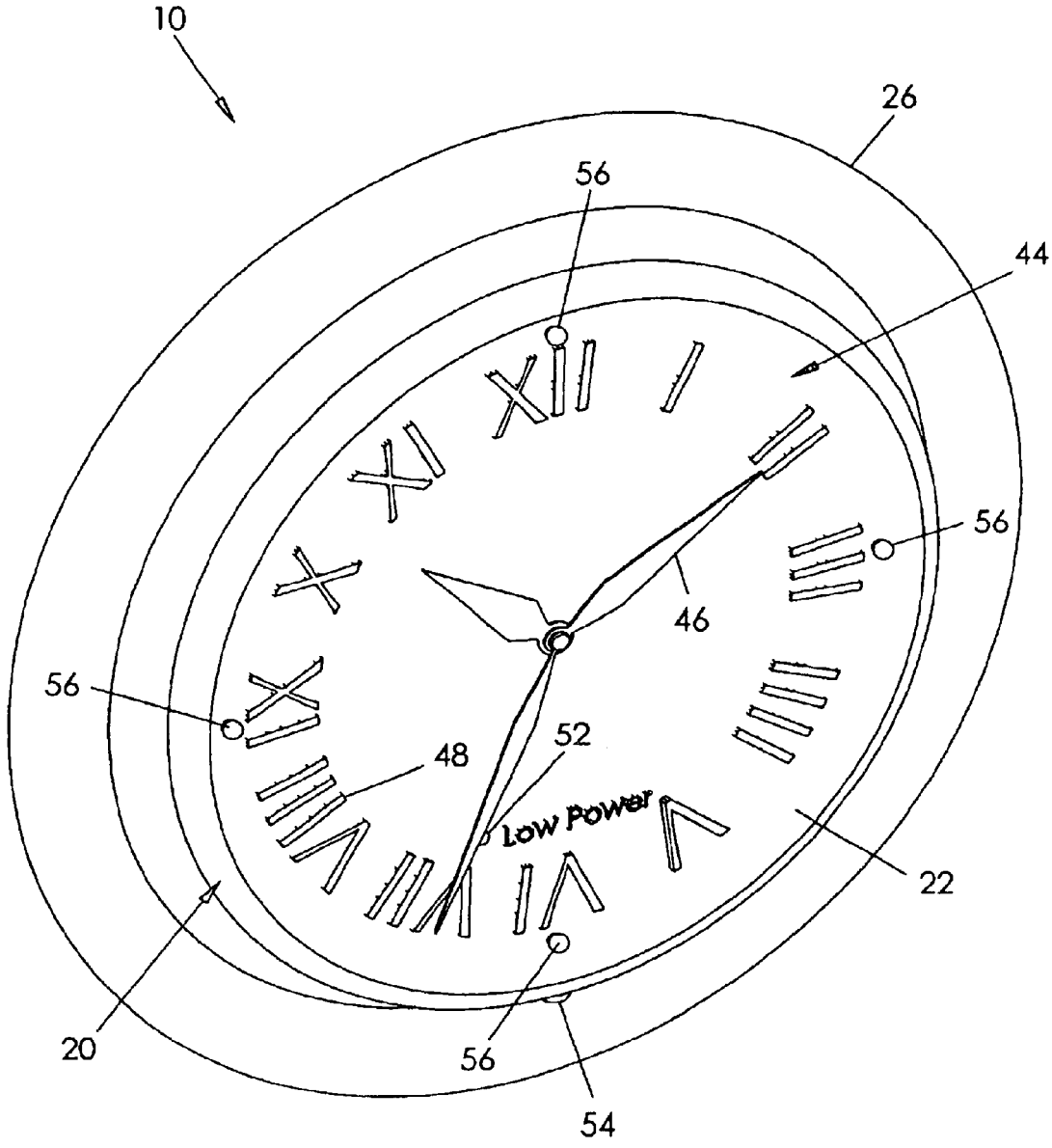
FIG. 1 is a perspective view of a clock and ambient air condition sensing apparatus according to one embodiment of the present invention.
Figure 2:
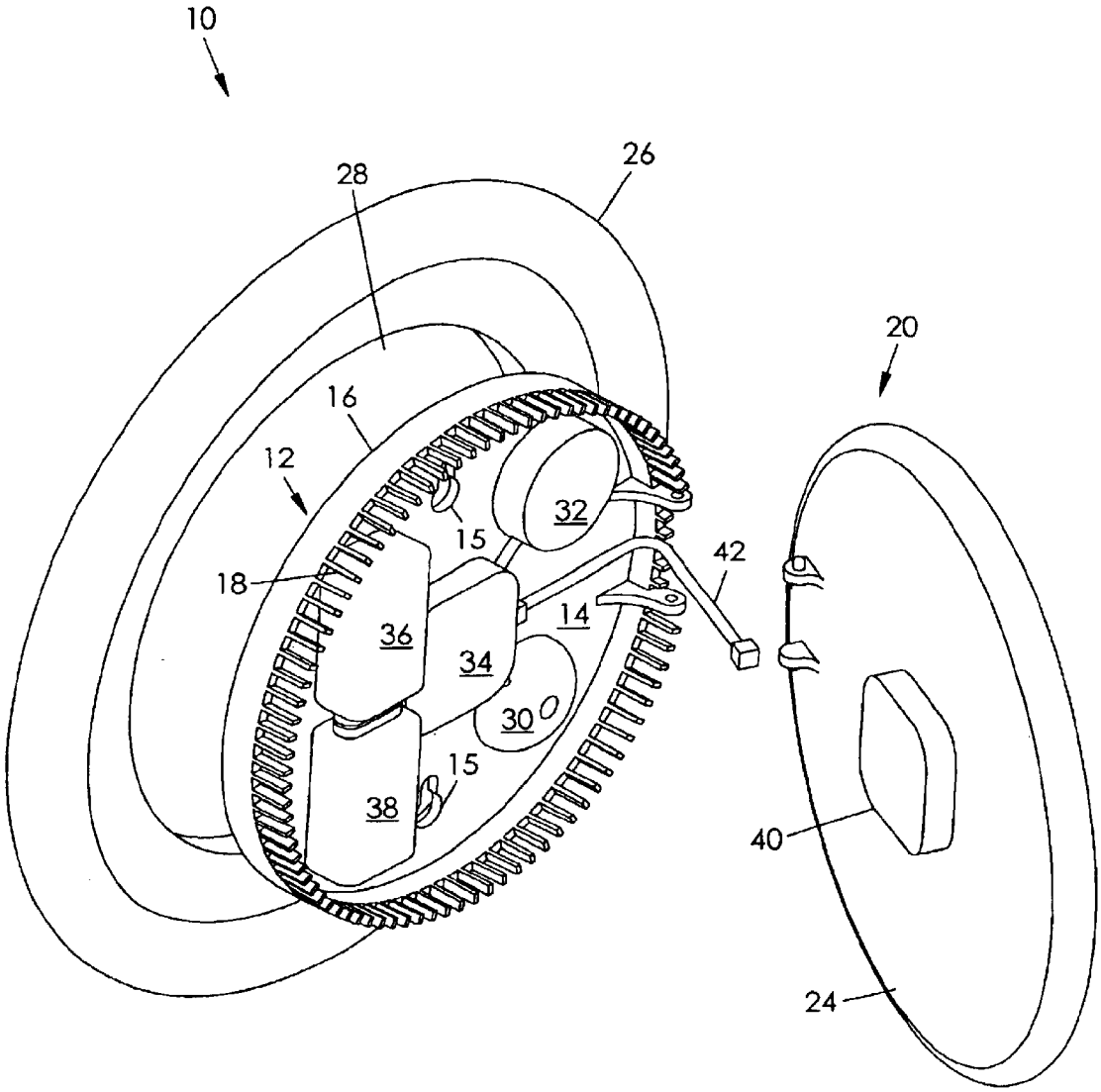
FIG. 2 is an exploded view of the apparatus as in FIG. 1.
Figure 3:
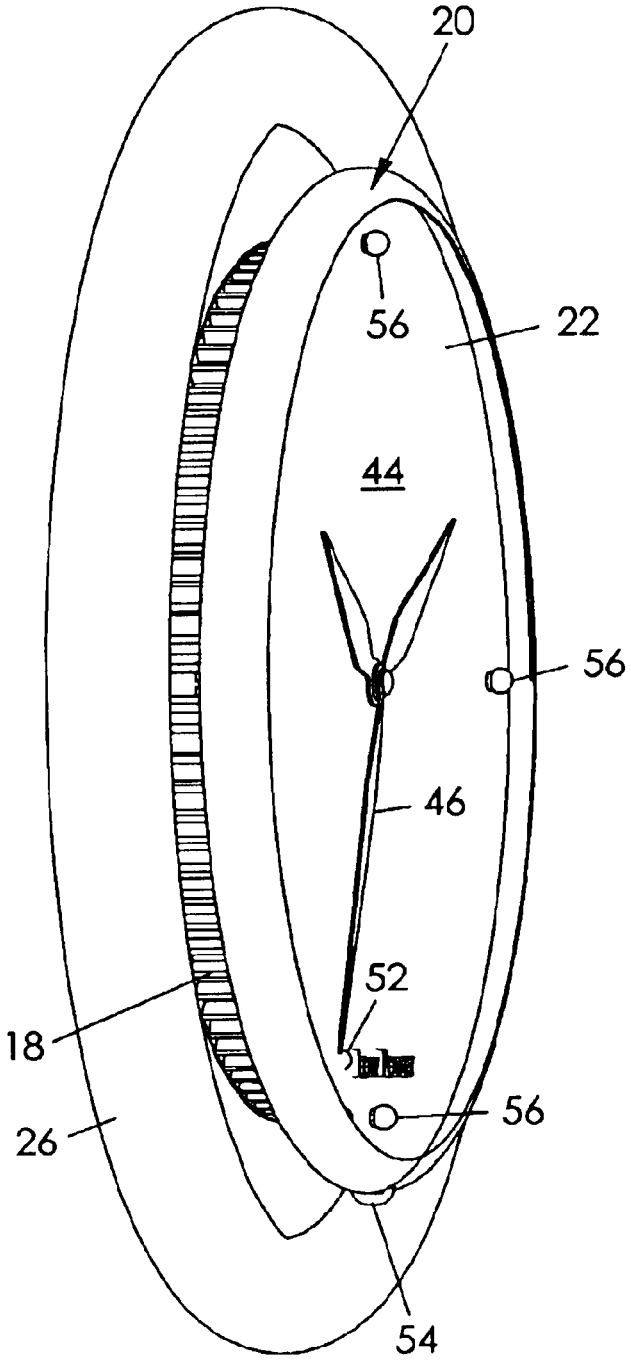
FIG. 3 is a side perspective view of the apparatus as in FIG. 1.
Figure 4A:
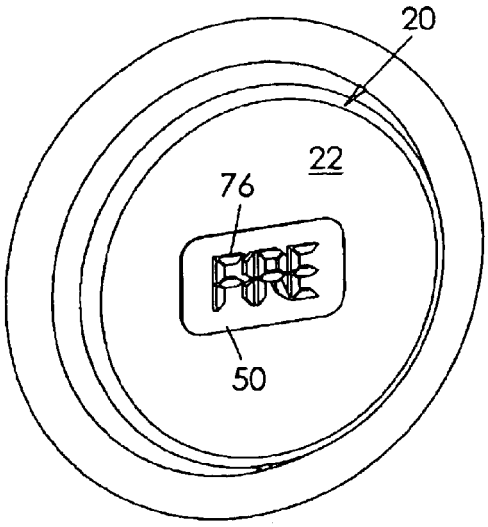
FIG. 4A is a perspective view of a clock and air condition sensing apparatus according to another embodiment of the present invention and showing a message displayed on a digital display.
Figure 4B:
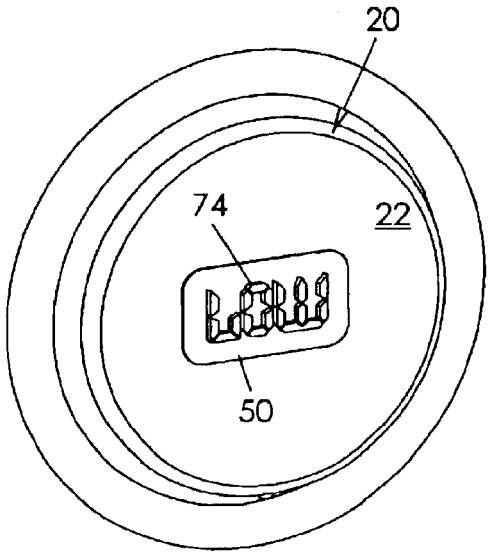
FIG. 4B is a perspective view of the apparatus as in FIG. 4A showing another message being displayed on the digital display.
Figure 4C:
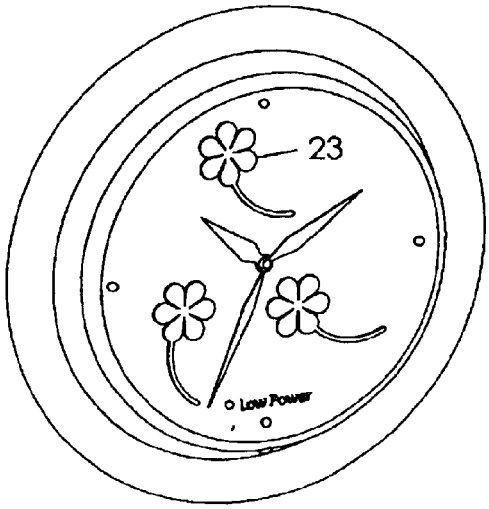
FIG. 4C is a perspective view of the apparatus as in FIG. 1 having a decorative clock face.

A clock and ambient air condition sensing apparatus 10 according to one embodiment is shown in FIGS. 1 through 3 and includes a housing 12 having a rear wall 14 and continuous side wall 16 defining a chamber (FIG. 2). While a circular configuration is preferred, a housing having a square, rectangular, or irregular configuration would also be suitable to form the chamber. The rear wall 14 of the housing 12 defines one or more mounting holes 15 configured to mate with conventional wall mounting means, such as nails, brackets, or the like. The walls of the housing 12 define an open front. A front cover 20 is pivotally coupled to the side wall 16 and is selectively movable between an open configuration (FIG. 2) and a closed configuration (FIG. 1). This pivotal configuration allows a user to conveniently access or replace the components positioned within the chamber, as to be more fully described below. The front cover 20 includes front 22 and rear 24 surfaces. The front surface 22 may present decorative indicia 23 (FIG. 4C).

Figure 4D:
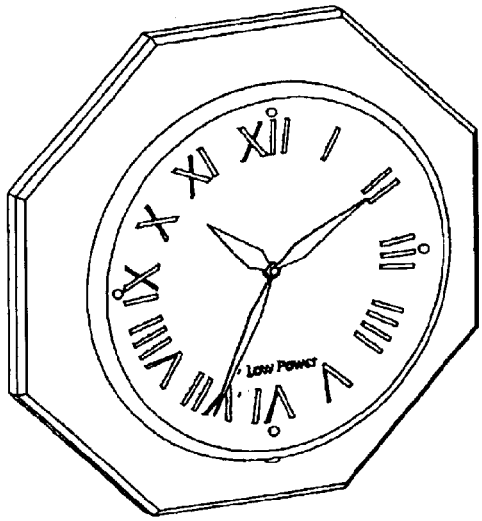
FIG. 4D is another perspective view of the apparatus as in FIG. 1 with a base member having another configuration.

The apparatus 10 may also include a base member 26 having a configuration complementary to that of the housing side wall 16 (FIGS. 1–3) although other configurations typical for wall clocks, e.g. octagonal, would also be suitable (FIG. 4D). Further, the base member 26 includes a diameter larger than a diameter of the housing 12. It should be appreciated that the base member 26 may define a void 28 into which the housing 12 may be positioned in a friction fit engagement (FIG. 2). Thus, the construction of the apparatus 10 may be modular so as to allow replacement of the entire housing 12 and components without replacing the base member 26.

An audible alarm 30 is mounted to the rear wall 14 of the housing 12 and is therefore positioned in the chamber (FIG. 2). An ambient air condition sensor 32 is also positioned in the chamber. Preferably, the ambient air condition sensor 32 is a smoke sensor although a heat, carbon monoxide, or other gas sensor would also be suitable. A programmable logic circuit 34 is positioned within the chamber and electrically connected to both the air sensor 32 and the alarm 30. First 36 and second 38 battery power sources are removably mounted within the chamber and are operatively connected to the logic circuit 34. The logic circuit 34 is capable of normally directing current from the first battery 36 to the air sensor 32.

The continuous side wall 16 of the housing 12 defines a plurality of apertures 18 through which ambient air may pass into the chamber for contact with the ambient air condition sensor 32 (FIG. 2). It should also be realized that the front cover 20 includes a diameter larger than a diameter of the side wall 16 such that the apertures 18 are substantially hidden when the front cover 20 is in the closed configuration (FIG. 3). A rounded configuration of a peripheral rim of the base member 26 and rounded configuration of a peripheral edge of the front cover 20 enhance the efficient flow of ambient air into the apertures 18 for the earliest possible detection of an ambient air condition.

The air sensor 32 is capable of delivering data signals to the logic circuit 34 relative to a predetermined type of air condition, e.g. smoke. In turn, the logic circuit 34 is capable of evaluating input signals and, therefore, is able to evaluate the data signals being received from the air sensor 32. If upon evaluation, the data signal indicates the existence of a predetermined air condition, the logic circuit 34 is programmed to energize the alarm 30.

A clock assembly 40 is mounted to the rear surface 24 of the front cover 20 and is releasably electrically connected to the logic circuit 34 with a quick-connect data cable 42 (FIG. 2). The logic circuit 34 is capable of directing current from the second battery to the clock assembly 40. Preferably, a conventional analog clock display 44 is mounted to the front surface 22 of the front cover (FIG. 1) and includes clock hands 46 and numerals 48. The clock assembly 40 is connected to and controlled by the clock assembly 40 in a conventional manner. Alternatively, a digital display 50 (FIGS. 4A and 4B) is mounted to the front surface 22 of the front cover 20 rather than an analog display 44. Various messages may be displayed on the digital display 50 other than a relative time, as to be further described later. It is understood that the front surface 22 of the front cover 20 may also include artistic designs, patterns, artwork, or photography for additional aesthetic appeal.

Figure 7A:
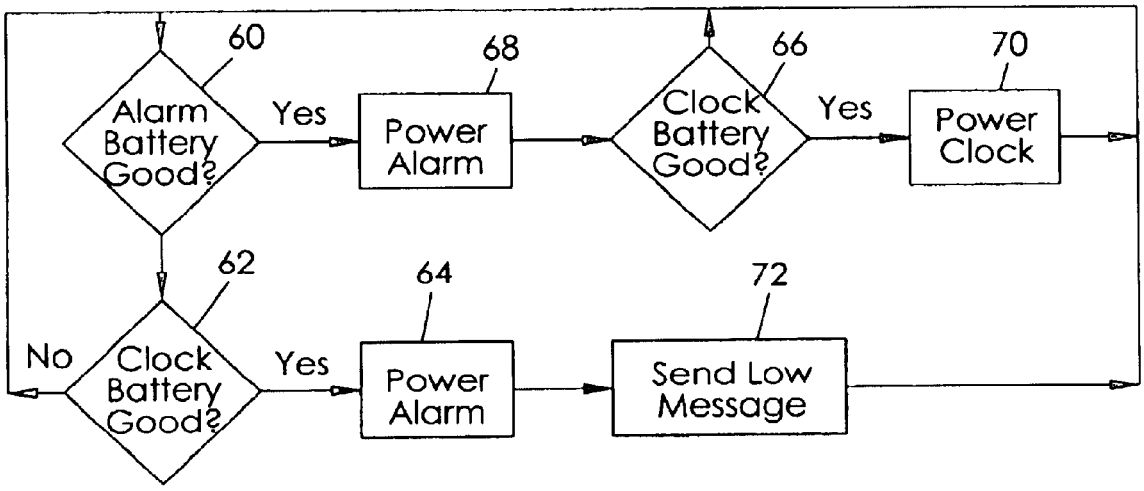
FIG. 7A is a flowchart showing the logic performed by the logic circuit for directing current from the dual battery power sources to the air condition sensor and clock.

The logic circuit 34 is capable of directing current from either battery to the air condition sensor 32 upon certain predetermined conditions. More particularly, the logic circuit 34 is capable of evaluating the operability of each battery. If no current is received from the first battery 36 or if the strength thereof falls below a predetermined voltage 60 while the second battery 38 is still operative 62, then the circuit 34 is programmed to direct current from the second battery 38 away from the clock assembly 40 and to the ambient air condition sensor 32 and alarm 30 instead, as indicated at 64 (FIG. 7A). Therefore, a user is alerted as to the failure of the first battery 36 by cessation of the clock function while the ambient air condition sensor 32 remains energized. The user may then replace the depleted first battery 36 without any break in functionality. Of course, if both the first 36 and second 38 batteries are operable 60, 66, then current is directed to the sensor 32/alarm 30 and clock assembly 40 as indicated at 68 and 70, respectively.

In addition, the apparatus 10 includes a low battery light emitting diode (LED) 52 positioned on the front surface 22 of the front cover 20 (FIG. 1) which is energized by the logic circuit 34 when the first battery 36 is inoperable, as indicated at 72 (FIG. 7A). When a digital display 50 is utilized with the apparatus 10, a digital message signal may be delivered thereto by the logic circuit 34 upon corresponding data evaluations. For example, a "LOW" battery message 74 may be sent to the digital display when the first battery 36 is evaluated as inoperable (FIG. 4B) and a "FIRE" message 76 may be delivered thereto when a predetermined ambient air condition is found (FIG. 4A).

Figure 7B:
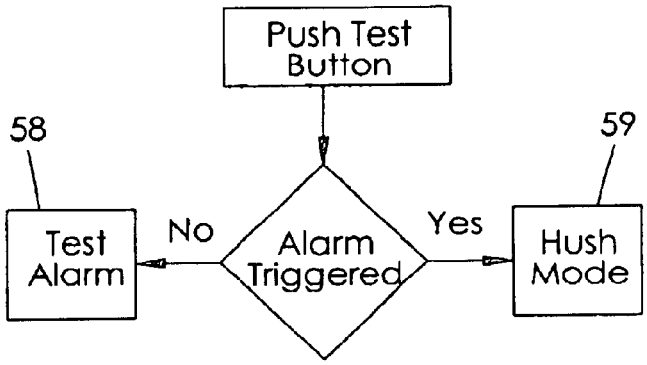
FIG. 7B is a flowchart showing the logic performed by the logic circuit for selectably silencing an energized alarm.

Further, the apparatus 10 includes a test button 54 situated on the front cover 20 (FIG. 3) and operatively connected to the logic circuit 34. Under normal conditions, the logic circuit 34 directs operation of a self-test procedure 58 to verify operability of the logic circuit 34, ambient air condition sensor 32, and batteries 36, 38 upon a depression of the test button 54 (FIG. 7B). However, the logic circuit 34 is programmed to disable the alarm 30 for a predetermined period of time if the alarm 30 is energized at the time the test button 54 is depressed, as indicated at 59 (FIG. 7B). A plurality of "hush mode" LED's 56 are positioned on the front surface 22 of the front cover 20 and sequentially energized while the alarm 30 is disabled (FIG. 3). More particularly, additional hush-mode LED's 56 are energized corresponding to the length of time the alarm has been disabled. Thus, a user may disable a false alarm for a period of time until the ambient air condition causing the false alarm is cleared.

In operation, the apparatus 10 may be mounted on a wall and provides an attractive clock appearance. The first 36 and second 38 batteries power the ambient air sensor 32 and clock assembly 40, respectively, when both batteries are operable. However, if the first battery 36 is deemed inoperable when evaluated by the logic circuit 34, current from the second battery 38 is directed to the ambient air condition sensor 32 and alarm 30 and the clock assembly 40 is rendered inoperable. The low battery LED 52 is simultaneously energized. Therefore, a user is alerted to the fact that the normal sensor battery is dead and needs to be replaced. However, the sensor 32 and alarm 30 continue to function such that the user continues to be protected.

Figure 5:
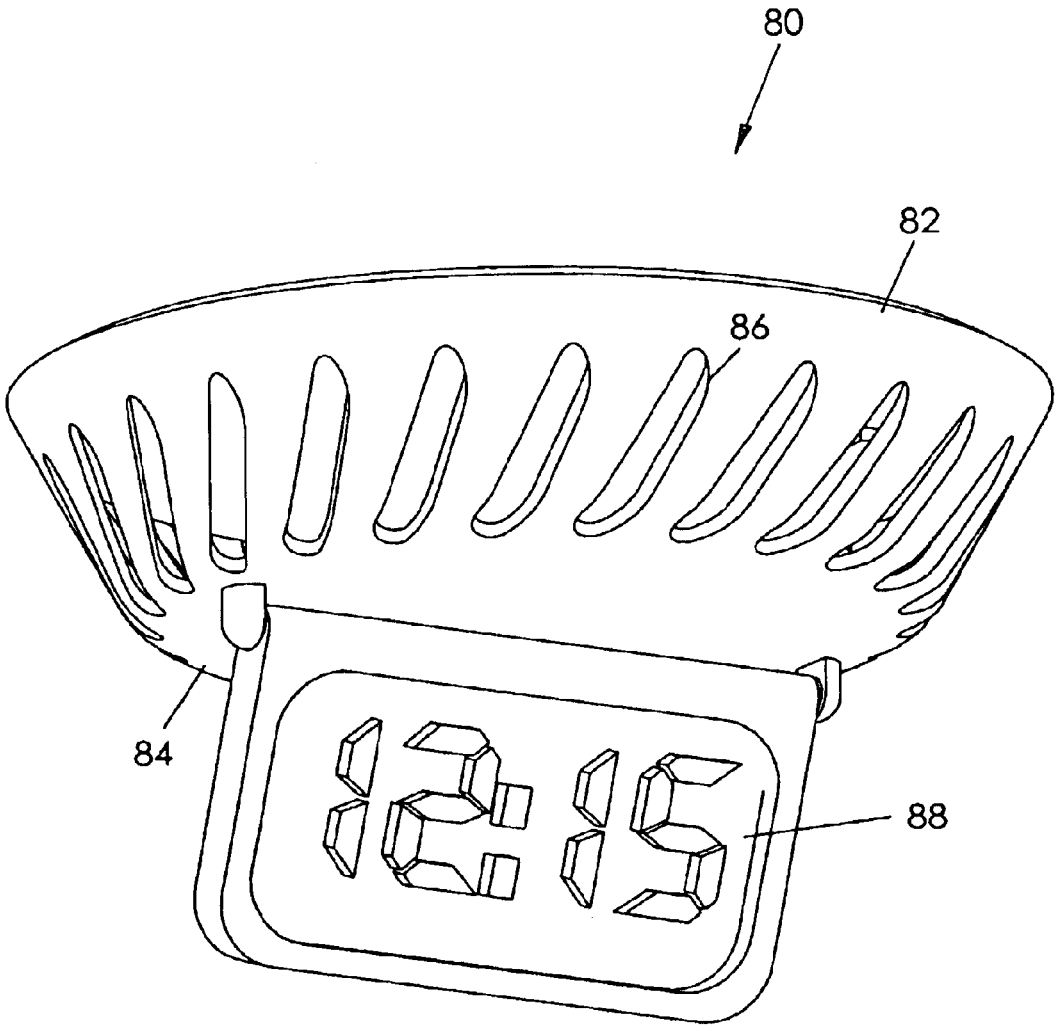
FIG. 5 is a perspective view of a clock and air condition sensing apparatus according to still another embodiment of the present invention.

A clock and ambient air sensing apparatus 80 according to another embodiment of the present invention is shown in FIG. 5 and includes a construction substantially similar to the construction of the apparatus 10 first described above except as specifically noted below. This apparatus 80 includes a housing 82 having a configuration specifically for being mounted to a ceiling. The housing 82 defines a plurality of apertures 86 for passage of ambient air therethrough. A digital display 88 is coupled to a lower wall 84 of the housing 80 and depends therefrom. Therefore, the apparatus 80 according to this embodiment is well suited for mounting, for example, in a school hallway or other institution. It is understood that the internal components function in a manner substantially similar to the manner previously described.

Figure 6:
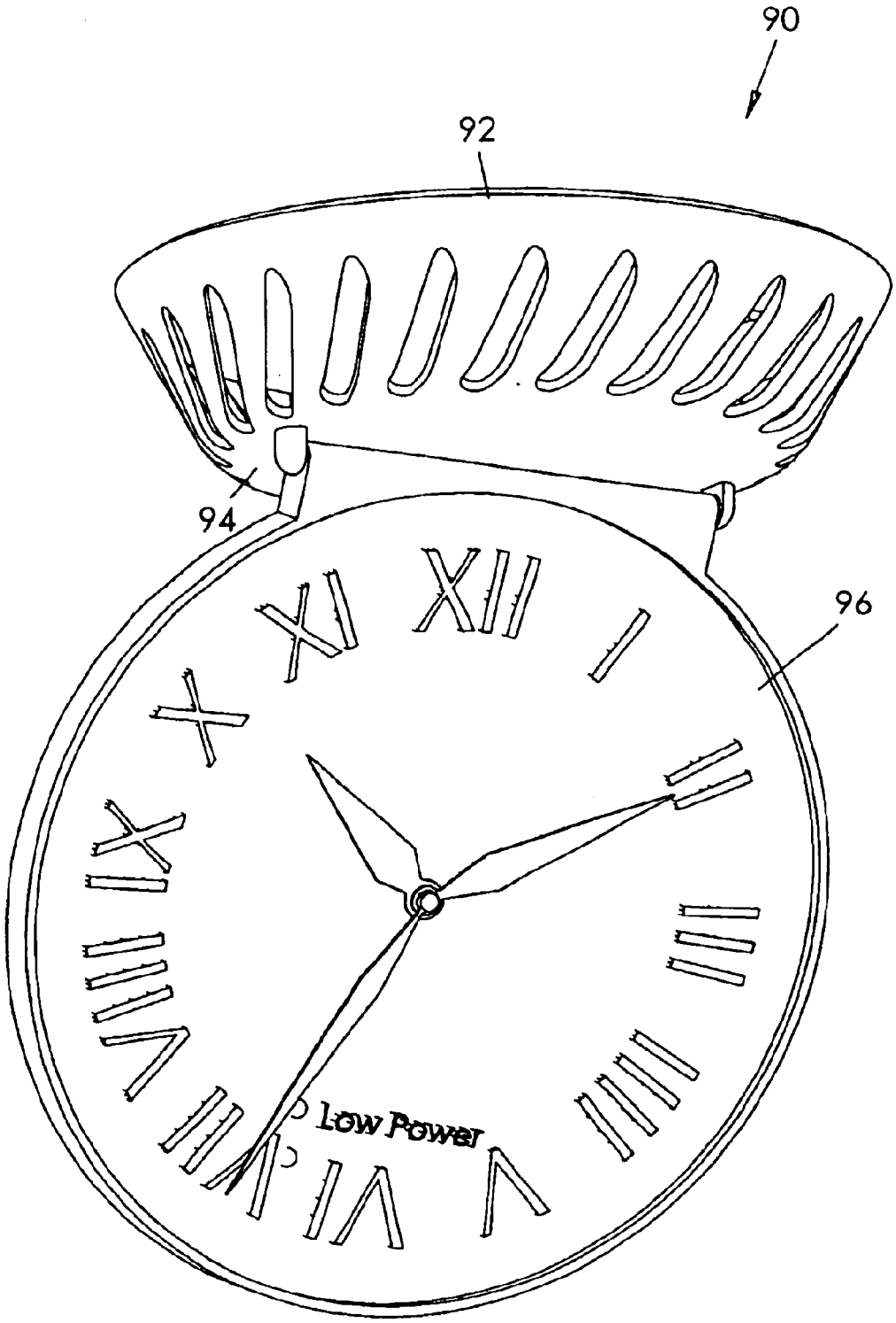
FIG. 6 is a perspective view of a clock and air condition sensing apparatus according to yet another embodiment of the present invention.

An apparatus 90 according to still another embodiment of the present invention is shown in FIG. 6 and includes a construction substantially similar to the construction described immediately above except as specifically noted below. In this apparatus 90, an analog display 96 is coupled to a lower wall 94 of a housing 92.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A clock and ambient air condition sensing apparatus, comprising:

a housing having opposed top and bottom walls with a continuous side wall extending between said top and bottom walls and defining a chamber, said side wall defining a plurality of apertures for passage of ambient air therethrough and into said chamber;

an alarm positioned in said chamber;

an ambient air condition sensor positioned in said chamber for providing a data signal corresponding to a preselected parameter of a condition of ambient air;

a logic circuit positioned in said chamber and capable of evaluating input data supplied thereto, said circuit being electrically connected to said ambient air condition sensor and including means for generating an output signal to energize said alarm if upon evaluation said data signal is indicative of a predetermined ambient air condition;

a first battery electrically connected to said circuit, said circuit including means for directing current from said first battery to said ambient air condition sensor;

a display means coupled to said bottom wall of said housing and depending therefrom for indicating a relative time;

a second battery electrically connected to said circuit, said circuit including means for directing current from said second battery to said display means; and means for providing battery strength data to said circuit for evaluation indicative of operation of said first and second batteries, said circuit including means for directing current from said second battery to said ambient air condition sensor if upon evaluation said battery strength data is indicative of an inoperability of said first battery.

2. The apparatus as in claim 1 wherein said display means is a digital display; and said apparatus further comprising means in said circuit for directing a message signal to said digital display corresponding to a predetermined alphabetic message indicative of a respective evaluation of said input data.

3. The apparatus as in claim 2 further comprising:

a test button operatively connected to said circuit; and means in said circuit for temporarily disabling said alarm for a predetermined period of time when said test button is depressed while said alarm is energized.

4. The apparatus as in claim 1 wherein said front cover includes a circular configuration having a diameter larger than a diameter of said continuous side wall for concealing said plurality of apertures.

5. The apparatus as in claim 1 further comprising a modular base member defining a void for removably receiving said housing therein in a friction fit engagement.

* * * * *